US007211212B2

(12) United States Patent
Kasashima

(10) Patent No.: US 7,211,212 B2
(45) Date of Patent: May 1, 2007

(54) GOLF BALL MANUFACTURING METHOD

(75) Inventor: Atsuki Kasashima, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 417 days.

(21) Appl. No.: 10/730,991

(22) Filed: Dec. 10, 2003

(65) Prior Publication Data

US 2004/0116209 A1 Jun. 17, 2004

(30) Foreign Application Priority Data

Dec. 12, 2002 (JP) ..... 2002-360647

(51) Int. Cl.
*B29C 45/14* (2006.01)
*B29C 59/02* (2006.01)

(52) U.S. Cl. ..... 264/279.1; 264/294

(58) Field of Classification Search ..... 264/279.1, 264/294
See application file for complete search history.

(56) References Cited

U.S. PATENT DOCUMENTS

| | | | | | |
|---|---|---|---|---|---|
| 721,462 | A * | 2/1903 | Richards | 264/275 |
| 2,361,348 | A * | 10/1944 | Dickson et al. | 264/278 |
| 5,006,297 | A * | 4/1991 | Brown et al. | 264/234 |
| 5,147,657 | A * | 9/1992 | Giza | 425/117 |
| 5,692,973 | A * | 12/1997 | Dalton | 473/374 |
| 6,132,544 | A * | 10/2000 | Ihara | 156/146 |
| 6,787,091 | B2 * | 9/2004 | Dalton et al. | 264/260 |

FOREIGN PATENT DOCUMENTS

JP 61-199872 A 9/1986

* cited by examiner

*Primary Examiner*—Edmund H. Lee
(74) *Attorney, Agent, or Firm*—Sughrue Mion, PLLC

(57) ABSTRACT

A golf ball comprising a core and a cover is manufactured by the steps of (A) enclosing the core with a thermoplastic resin and (B) tailoring the thermoplastic resin layer by applying heat and pressure thereto, for adjusting the thickness of the thermoplastic resin layer to 0.3-1.0 mm. A golf ball whose cover layer has a very thin and uniform thickness as well as an improved outer appearance is manufactured. The golf ball can derive the rebound and other characteristics of the core to the maximum extent.

9 Claims, 3 Drawing Sheets

GOLF BALL MANUFACTURING METHOD

BACKGROUND OF THE INVENTION

1. Field of the Invention

This invention relates to a method for manufacturing a golf ball comprising a core and a cover of one or more layers around the core, the method being capable of forming the cover layer uniformly to a significantly reduced thickness.

2. Background Art

In golf balls comprising a core and a cover of one or more layers around the core, the materials and thicknesses of the core and the cover and combinations thereof are selected as appropriate in accordance with the various characteristics required as competition balls and the favor of players.

Since the core makes a major contribution to the rebound of golf balls, the cover layer is advantageously formed thinner if flight performance is of more interest.

In the prior art, solid golf balls comprising a spherical core of an elastomer, typically rubber, enclosed with a resin cover are manufactured in several ways. For example, one typical method uses a mold consisting of a pair of upper and lower split mold halves which define a spherical cavity when mated, have a plurality of dimple-shaping protrusions on their inner wall and are provided with a plurality of vertically extending support pins. An elastic core is vertically held in place within the cavity by means of the support pins. A cover material is injected around the core to form a cover.

However, the injection molding technique is difficult to form a cover uniformly to a thickness of 1 mm or less. The reason is described below. Typically four to eight gates are disposed in the parting plane between the mold halves corresponding to the equator of the cavity. The injection pressure of the cover material from these gates is very high along the equator. The support pins are retracted to be flush with the mold inner wall immediately before the end of cover material injection. After the retraction of support pins, the injection pressure of the cover material causes the core to be deformed into an elliptic or rugby ball shape elongated in polar directions, and the cover is molded on the core in the deformed state. As a result, the golf ball as molded has the cover which is thicker near the equator and thinner near the opposite poles, and in extreme cases, so thin that the dimple bottom is in direct contact with the core surface. The resulting golf ball lacks uniformity substantially. Thin cover portions are formed near the opposite poles because the space between the core surface and the mold inner wall is narrow, which can obstruct the flow of the cover material during injection molding. This results in that weld marks are left on the cover surface after the molding, detracting from the outer appearance. Thus the above-described method is difficult to manufacture golf balls having a cover which is as thin as 1 mm or less.

In another known method, as also described in JP-A 61-199872, a spherical elastic core is encased in a pair of half shells which have been separately molded from resinous cover material. The assembly is placed in a spherical cavity defined by a pair of upper and lower mold halves having a plurality of dimple-shaping protrusions on their inner wall, where compression molding is effected by applying heat and pressure.

When the cover is molded in this way, the air trapped between the shells on the core and the mold inner wall and any extra cover material (often amounting to so much) run out from the parting plane between the mold halves. Fins are formed by curing of the run-out cover material and integrated with the golf ball as molded. It is cumbersome to trim the fins and polish for finishing. Additionally, the trapped air is not completely expelled. Residual air trap causes defective outer appearance, resulting in balls to be rejected.

There remains a need for golf balls having a cover layer whose thickness is very thin and uniform and which has an aesthetic outer appearance.

SUMMARY OF THE INVENTION

An object of the present invention is to provide a method for manufacturing a golf ball having a cover layer formed to a very thin and uniform thickness, and a golf ball manufactured thereby.

It has been found that a golf ball having a cover layer whose thickness is very thin and uniform and which has an aesthetic outer appearance is obtainable by forming a cover layer of an appropriate thickness on the surface of a core from a thermoplastic resin, and then tailoring the cover layer for adjusting its thickness through application of heat and pressure.

According to the present invention, there is provided a method for manufacturing a golf ball comprising a core and a cover composed of one or more layers around the core, the method comprising the steps of (A) enclosing the core with a thermoplastic resin, and (B) tailoring the thermoplastic resin layer by applying heat and pressure thereto, for adjusting the thickness of the thermoplastic resin layer to 0.3 to 1.0 mm.

Preferably, the step (A) of enclosing the core with a thermoplastic resin includes injection molding a thermoplastic resin around the core. The injection molding step typically uses an injection mold which consists essentially of two split mold sections having inner surfaces that define a spherical cavity having an equator when mated, has a parting plane in alignment with the equator of the spherical cavity, and has a plurality of resin-injecting gates open at the spherical cavity-defining inner surfaces. In the preferred injection mold, the plurality of resin-injecting gates open at the spherical cavity-defining inner surfaces are disposed in the parting plane.

Preferably, the step (B) of tailoring the thermoplastic resin layer by applying heat and pressure thereto includes applying heat and pressure to the thermoplastic resin layer enclosing the core in a tailoring mold. Typically, the tailoring mold consists essentially of a plurality of split mold sections having inner surfaces that define a spherical cavity when mated and defining a parting plane therebetween, and has holes and/or slits disposed in the parting plane for communication between the interior and the exterior of the mold. In the preferred tailoring mold, a plurality of protrusions are disposed on the spherical cavity-defining inner surfaces for shaping dimples.

The thermoplastic resin is often a thermoplastic urethane resin.

In one embodiment wherein the cover is composed of a plurality of layers, the step (A) of enclosing the core with a thermoplastic resin is to enclose the core, which has been enclosed with a cover inner layer, with a cover outermost layer, the cover outermost layer being contiguous to the cover inner layer. The cover outermost layer and the cover inner layer are preferably formed of thermoplastic resins of substantially the same color.

Also contemplated herein is a golf ball manufactured by the method defined above.

DESCRIPTION OF THE PREFERRED EMBODIMENTS

Figure 1:
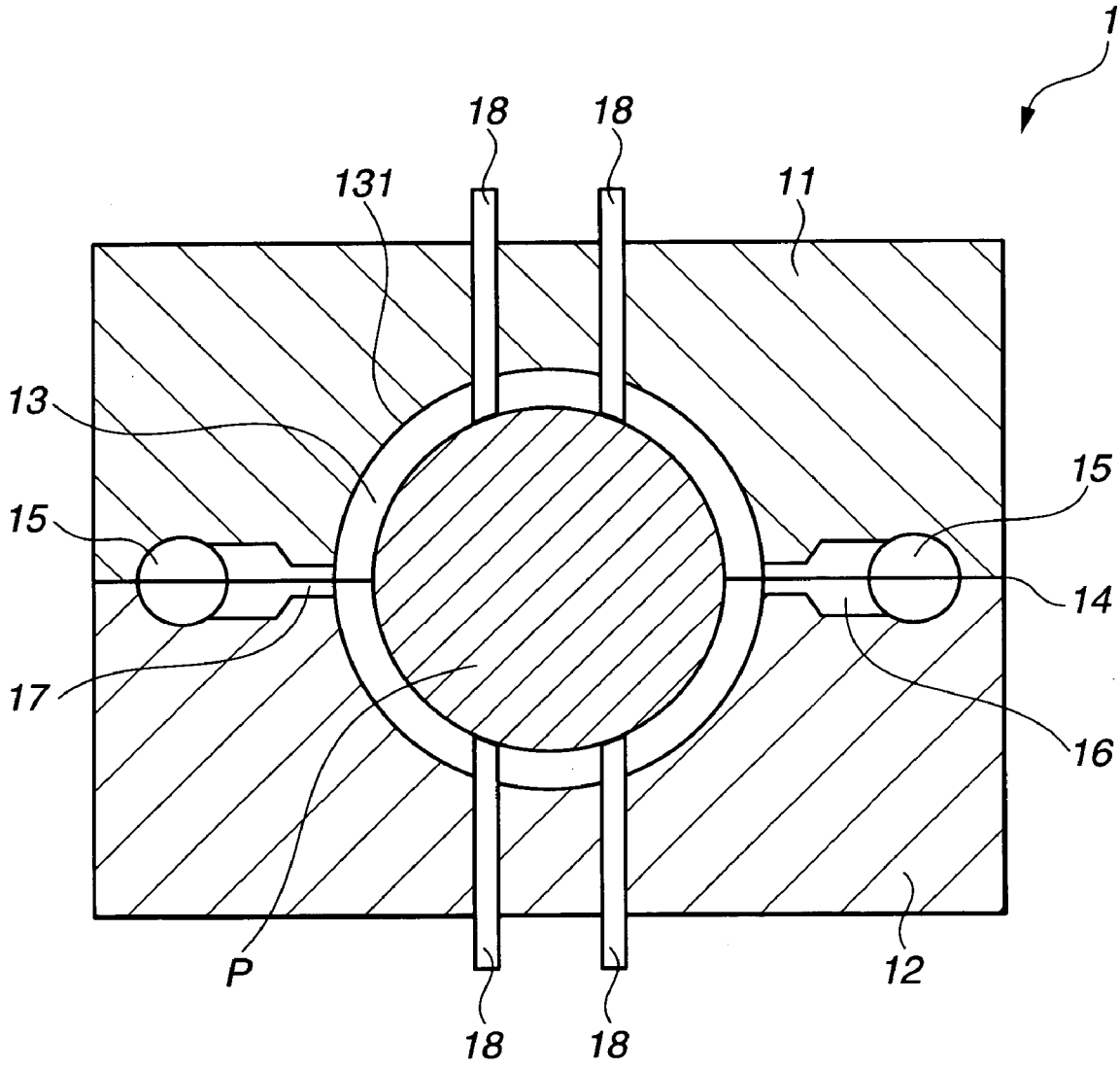
FIG. 1 is a schematic cross-sectional view of an injection mold used in step (A).

According to the invention, a golf ball comprising a core and a cover of one or more layers around the core is manufactured by (A) enclosing the core with a thermoplastic resin, and (B) tailoring the thermoplastic resin layer by applying heat and pressure thereto, for adjusting the thickness of the thermoplastic resin layer to 0.3 mm to 1.0 mm.

An elastic core is generally used in step (A) of enclosing the core with a thermoplastic resin although the core that can be used herein is not critical. The elastic core has been molded into a spherical shape using a thermosetting elastomer and/or thermoplastic elastomer-based material, typically a well-known rubber material and any known molding technique such as press molding or injection molding.

The process of enclosing the core with a thermoplastic resin to form a thermoplastic resin layer is not critical, and any well-known process may be used. For example, the core is encased in a pair of half shells which have been separately molded from a resinous cover material, and heat and pressure are applied to the entirety within a mold having a spherical cavity. Alternatively, the core is held at the center of a spherical mold cavity by support pins, following which a cover material is injection molded around the core. Of these, the injection molding process is preferred when such factors as an outer appearance and a need for polishing after molding are taken into account.

In step (A), the thermoplastic resin layer is formed around the core to a thickness which is generally in the range of 0.5 mm to 1.5 mm, preferably in the range of 0.8 mm to 1.2 mm, though not critical. If the thickness of the thermoplastic resin layer formed in step (A) is more than 1.5 mm, the object of the invention to form a thin cover may not be attained. If the thickness is less than 0.5 mm, molding is sometimes difficult.

The thermoplastic resin used herein is preferably selected from thermoplastic urethane resins and ionomer resins. Of these, thermoplastic urethane resins are preferred because they have excellent characteristics as the golf ball cover material and a favorable flow behavior during molding.

In the preferred embodiment wherein step (A) of enclosing the core with a thermoplastic resin involves injection molding a thermoplastic resin around the core, an injection mold is preferred which consists essentially of two split mold sections having inner surfaces that define a spherical cavity having an equator when mated. The mold has a parting plane in alignment with the equator of the spherical cavity. The mold has a plurality of gates open at the spherical cavity-defining inner surfaces for injecting the resin therethrough.

With respect to the position of resin-injecting gates, it is most preferred for restraining deformation of the core situated within the cavity during injection molding that the resin-injecting gates be disposed such that the thermoplastic resin may be injected three-dimensionally uniformly relative to the core (as will be described in conjunction with FIG. 3). When the cost of mold manufacture is taken into account, satisfactory injection molding is possible with the mold in which the plurality of resin-injecting gates open at the spherical cavity-defining inner surfaces are disposed in the parting plane. The number of resin-injecting gates is generally 4 to 20.

In the preferred embodiment wherein step (A) involves injection molding a thermoplastic resin around the core, support pins are advantageously used for holding the core at the center of the mold cavity. When a mold consisting essentially of two split mold sections having inner surfaces that define a spherical cavity when mated as mentioned above is used in injection molding, a plurality of support pins are arranged at an equal spacing along a circumference about the pole of each of the upper and lower mold sections, oriented in a direction perpendicular to the parting plane, and mounted in a retractable manner. The number of support pins is generally 3 to 7 for each mold section.

While the core is held in place within the mold cavity by the support pins, the thermoplastic resin is injected into the space between the core and the cavity. The support pins are retracted to be flush with the cavity-defining inner surface of the mold immediately before the end of injection.

The core thus enclosed with the thermoplastic resin is cooled to a predetermined temperature and removed from the mold before it proceeds to step (B).

Step (B) is to tailor the thermoplastic resin layer by applying heat and pressure thereto, for adjusting the thickness of the thermoplastic resin layer. Preferably, step (B) includes applying heat and pressure to the thermoplastic resin layer enclosing the core in a tailoring mold.

The preferred tailoring mold consists essentially of a plurality of split mold sections having inner surfaces that define a spherical cavity when mated and having a parting plane. The mold has small holes and/or slits, serving primarily as vents, disposed in the parting plane for communication between the interior and the exterior of the mold. The number of split mold sections is not critical and it is acceptable to employ a mold of two, three, four, six or eight split mold sections.

The shape of holes is not critical. The holes may be of any desired cross-sectional shape like a circular, elliptic or polygonal shape. Slits providing continuous or intermittent communication between the interior and the exterior of the mold may be formed instead of or in combination with the holes. When small holes have a circular cross-sectional shape in proximity to the cavity, the diameter is preferably in the range of 0.5 mm to 1.5 mm.

The number of holes is not critical and may be determined as appropriate in accordance with the number of split mold sections. For an exemplary mold of two split sections defining a spherical cavity, four to twenty holes are preferably arranged in or near the parting plane and at a substantially equal spacing along a horizontal circumference of the spherical cavity.

The holes not only serve primarily as vents as mentioned above, but may also serve as ports for discharging the extra resin. The tailoring mold provided with such holes minimizes formation of the fins of resin that can form to a large extent in the parting plane during molding, as compared with the conventional split mold without such holes. The cured product (referred to as spew, hereinafter) formed within the hole from the extra resin is easy to trim off.

When the cover outermost layer of the golf ball is formed using the tailoring mold, it is recommended to use a tailoring mold in which a plurality of protrusions for shaping dimples are disposed on the spherical cavity-defining inner wall. The size and number of dimple-shaping protrusions are not critical.

What is formed through steps (A) and (B) according to the invention is preferably the cover outermost layer having dimples thereon. Therefore, in the case of a two-piece golf ball consisting of a core and a cover, a golf ball having the cover with a predetermined thickness of 0.3 to 1.0 mm around the core is manufactured through steps (A) and (B). In the case of a multi-piece golf ball consisting of a core and a cover of plural layers (an intermediate layer and an outermost layer when the cover is formed of two layers), the core is previously enclosed with the intermediate layer prior to step (A). The core enclosed with the intermediate layer is subjected to steps (A) and (B), whereby the desired ball is manufactured.

Since the elastic core used herein is typically molded from a rubber-base material by press working, molding to a true sphericity is very difficult. With a low sphericity, it is impossible to mold the cover to a uniform thickness. Then a procedure of forming an intermediate layer around the core by the method of the invention for improving the sphericity of the core, and then forming a cover layer thereon by the method of the invention again ensures that the cover layer is shaped to a uniform thickness.

In a preferred embodiment wherein the intermediate layer is formed of a material having a higher hardness than the core, even when a cover layer is formed over the intermediate layer by injecting the cover material through the gates under high pressure, the intermediate layer advantageously functions to restrain deformation of the core by the injection pressure. This ensures formation of a uniform thin skin and eventually formation of a cover having a uniform thickness.

When the intermediate layer is formed by the method of the invention, the material of the intermediate layer is not critical as long as it is a thermoplastic resin. For example, an ionomer resin is preferred. The thickness of the intermediate layer is preferably 0.09 mm to 3 mm, more preferably 1 mm to 2 mm. If the intermediate layer is thicker than 3 mm, rebound characteristics may be exacerbated. If the thickness is less than 0.09 mm, the ball may be liable to failure.

After the intermediate layer is formed around the core, a cover layer is formed thereon by the method of the invention. When it is desired to form the cover layer to a very thin gage, the intermediate layer can partially exude along the parting plane of the mold used in step (A) or (B). If the cover layer is the cover outermost layer, resin compositions for the intermediate and outermost layers are preferably formulated such that the thermoplastic resin of which the outermost layer is formed and the thermoplastic resin of which the intermediate layer (contiguous to the outermost layer) is formed are of substantially the same color, thereby preventing any exudate from becoming noticeable.

Figure 2:
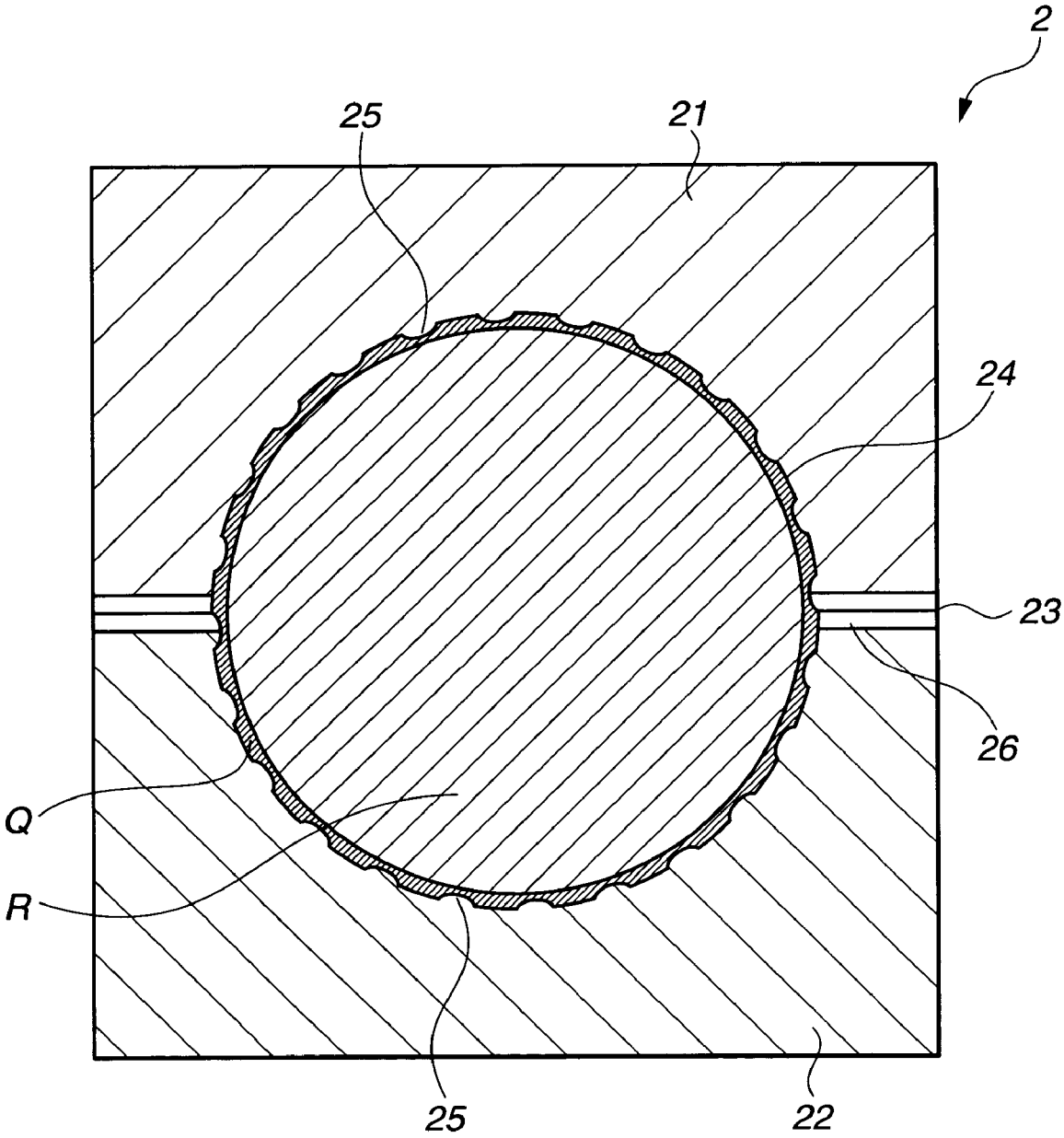
FIG. 2 is a schematic cross-sectional view of a tailoring mold used in step (B).
Figure 3:
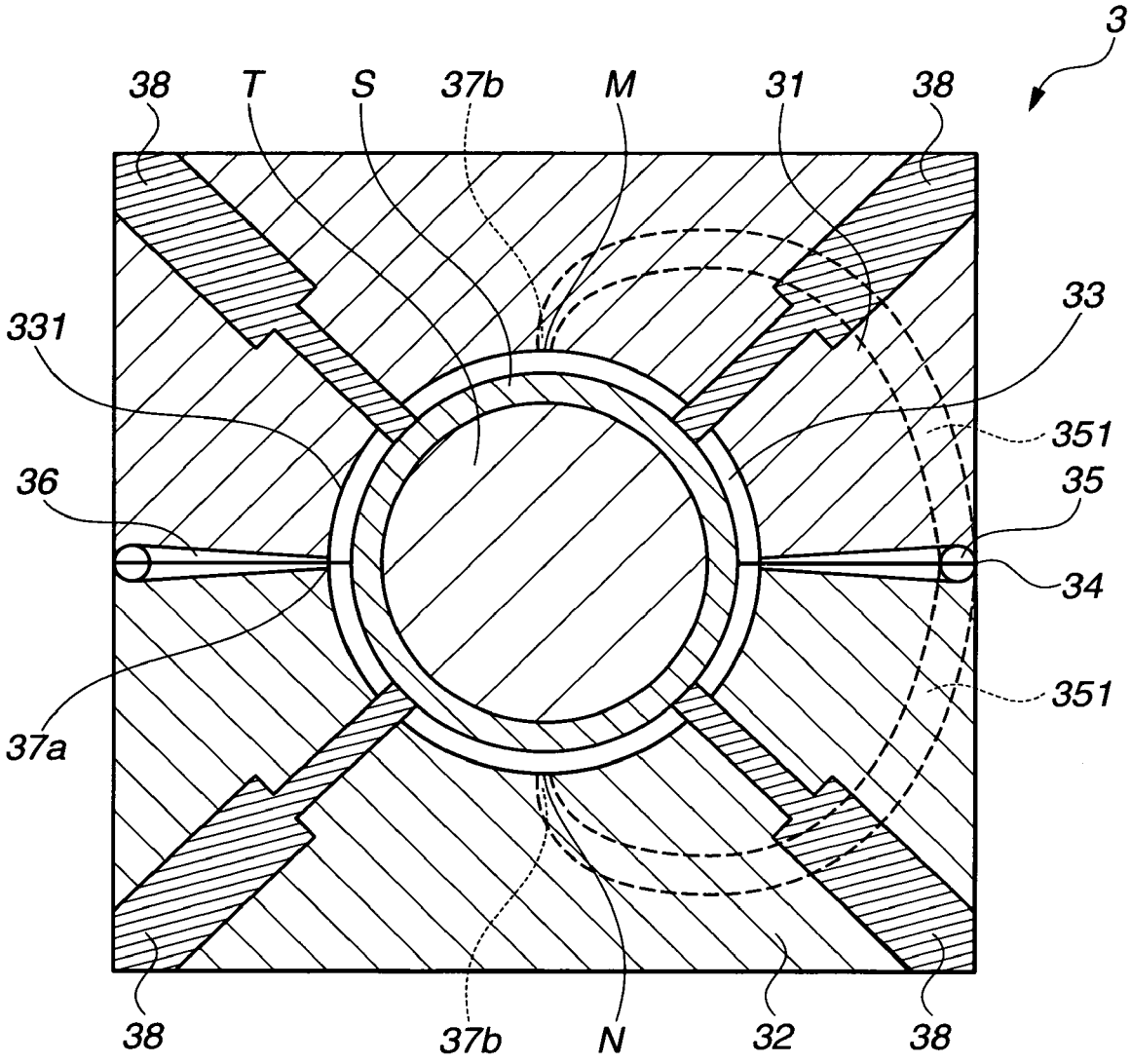
FIG. 3 is a schematic cross-sectional view of another injection mold used in step (A).

Referring to FIGS. 1 to 3, embodiments are described for illustrating the invention.

FIG. 1 is a schematic cross-sectional view of an injection mold 1 used in step (A) of the inventive method, which accommodates a core P therein.

The injection mold 1 includes upper and lower mold sections 11 and 12 having inner surfaces 131 that define a spherical cavity 13 when mated. Assume that the cavity 13 has an equator. A parting plane 14 is defined between the upper and lower mold sections 11 and 12 and in alignment with the equator of the spherical cavity 13.

On the parting plane 14 of the mold, an annular runner 15 is disposed so as to surround the cavity 13 for feeding a cover material thereto. The runner 15 is in fluid communication with the cavity 13 via nozzles 16 and gates 17. In the mold 1, four to twenty gates 17 open at the cavity-defining inner surface are arranged at an equal spacing along the parting plane.

The inner surface 131 defining the cavity 13 is a substantially smooth spherical surface. The core P is vertically held in place within the cavity 13 by vertically extending upper and lower support pins 18.

The support pins 18 for holding the core P in place are arranged at an equal spacing along a circumference about the pole of each of the upper and lower mold sections 11 and 12, oriented in a direction perpendicular to the parting plane 14, and mounted in a retractable manner. The support pins 18 are moved forward within the cavity 13 as shown in FIG. 1 when the core P is held thereby. A thermoplastic resin as cover material is injected into the cavity 13 through the gates 17 to form a thermoplastic resin layer around the core P. The support pins 18 are retracted to be flush with the inner surface 131 immediately before the end of injection.

The molded body is cooled to a predetermined temperature and taken out of the injection mold 1 before it proceeds to step (B).

FIG. 2 is a schematic cross-sectional view of a tailoring mold used in step (B) of the inventive method, which accommodates therein the core R enclosed with the cover layer Q by step (A).

Like the injection mold 1, the tailoring mold 2 includes upper and lower mold sections 21 and 22 having inner surfaces 24 that define a spherical cavity when mated. Assume that the cavity has an equator. A parting plane 23 is defined between the upper and lower mold sections 21 and 22 and in alignment with the equator of the spherical cavity. The cavity-defining inner surface 24 is formed with a multiplicity of protrusions 25 for shaping dimples.

The tailoring mold 2 includes holes 26 disposed in the parting plane 23 for communication between the cavity and the exterior of the mold. In the illustrated embodiment, four to twenty holes 26 are arranged at an equal spacing on the cavity-defining inner surface.

The core R enclosed with the cover layer Q by step (A) is placed in the tailoring mold 2 where an amount of heat necessary for the cover material to plasticize again and a predetermined pressure are vertically applied to the cover from the upper and lower mold sections 21 and 22 for thereby adjusting the thickness of the cover layer.

At this point, the air trapped between the cover layer and the cavity-defining inner surface is vented through the holes 26. At the same time, the cover material is discharged through the holes 26 together with the air if the cover material is excessive relative to the preset thickness of the cover layer. Then the cover layer is tailored to the target thickness.

The cover shaping in the tailoring mold 2 is also effective for ameliorating appearance defects on the cover surface including the weld marks which can be observed on the cover surface at the end of step (A) as a result of incomplete degassing and the support pin traces which can be generated on the cover surface when the retraction timing of support pins is delayed for minimizing core deformation. There is obtained a golf ball with a cover having a good appearance surface.

After the cover is shaped in the tailoring mold 2 according to step (B) of the inventive method, the spew in the form of cured cover material within holes 26 is trimmed. If fins are formed at the parting plane 23 of the mold, such fins are similarly trimmed off. Thereafter, conventional post-treatments including polishing and painting are carried out, yielding the desired golf ball.

FIG. 3 is a schematic cross-sectional view of another injection mold 3 which is different from the injection mold 1 shown in FIG. 1. The mold 3 accommodates in its cavity a core T which has been separately enclosed with an intermediate layer S.

Like the mold 1, the injection mold 3 includes upper and lower mold sections 31 and 32 having inner surfaces that define a spherical cavity 33 when mated. Assume that the cavity 33 has an equator. A parting plane 34 is defined between the upper and lower mold sections 31 and 32 and in alignment with the equator of the cavity 33. On the parting plane 34 of the mold, an annular runner 35 is disposed so as to surround the cavity 33 for feeding a cover material thereto. The runner 35 is in fluid communication with the cavity 33 via nozzles 36 and gates 37*a*.

The mold 3 is characterized in that runner branches 351 extend from the runner 35 first perpendicular to the parting plane 34 and then curvilinearly and communicate to the cavity 33 at the poles M and N of the cavity via gates 37*b* and that support pins 38 extend from the center of the cavity 33 in directions having an angle of 45° relative to a vertical axis passing the poles M and N and are mounted for retraction relative to the center of the cavity 33 and arranged in good balance. With respect to the gate 37*a* disposed on the parting plane 34, a plurality of such gates may be arranged in accordance with the mold 1 embodiment of FIG. 1.

At the center of the cavity 33, the core T enclosed with the intermediate layer S is held by the support pins 38. A cover material is injected into a uniform space between the inner surface 331 of the cavity 33 and the intermediate layer S and toward the center of the cavity 33 through the gates 37*a* and 37*b* to form a new cover layer.

By injecting a new cover material from orthogonal directions, the deformation of the core T and/or intermediate layer S by the injection pressure is significantly reduced. This is advantageous in shaping the cover material thin and to a uniform thickness.

There has been described a method for manufacturing a golf ball having a cover layer with a very thin and uniform thickness as well as an improved outer appearance. The golf ball manufactured thereby can derive the rebound and other characteristics of the core to the maximum extent.

Japanese Patent Application No. 2002-360647 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for manufacturing a golf ball comprising a core and a cover composed of one or more layers around the core, said method comprising the steps of:

(A) enclosing the core with a thermoplastic resin layer, and (B) tailoring the thermoplastic resin layer by applying heat and pressure thereto, for adjusting the thickness of the thermoplastic resin layer to 0.3 to 1.0 mm;

wherein the step (B) of tailoring the thermoplastic layer by applying heat and pressure thereto includes applying heat and pressure to the thermoplastic resin layer enclosing the core in a tailoring mold;

wherein the tailoring mold consists essentially of a plurality of split mold sections having inner surfaces that define a spherical cavity when mated and defining a parting plane therebetween, and has holes and/or slits disposed in the parting plane for communication between the interior and the exterior of the mold; and wherein in the tailoring mold, a plurality of protrusions are disposed on the spherical cavity-defining inner surfaces for shaping dimples.

2. The method of claim 1 wherein the step (A) of enclosing the core with a thermoplastic resin includes injection molding a thermoplastic resin around the core.

3. The method of claim 2 wherein the injection molding step uses an injection mold which consists essentially of two split mold sections having inner surfaces that define a spherical cavity having an equator when mated, has a parting plane in alignment with the equator of the spherical cavity, and has a plurality of resin-injecting gates open at the spherical cavity-defining inner surfaces.

4. The method of claim 3 wherein in the injection mold, the plurality of resin-injecting gates open at the spherical cavity-defining inner surfaces are disposed in the parting plane.

5. The method of claim 1 wherein said thermoplastic resin is a thermoplastic urethane resin.

6. The method of claim 1 wherein the cover includes a plurality of layers, and the step (A) of enclosing the core with a thermoplastic resin is to enclose the core, which has been enclosed with a cover inner layer, with a cover outermost layer, the cover outermost layer being contiguous to the cover inner layer.

7. The method of claim 6 wherein the cover outermost layer and the cover inner layer are formed of thermoplastic resins of substantially the same color.

8. The method of claim 1 wherein step (A) uses a first mold for enclosing the core with the thermoplastic resin layer and step (B) uses a second mold for tailoring the thermoplastic resin layer.

9. The method of claim 1 wherein the thermoplastic resin layer is cooled after step (A) and before step (B).

* * * * *